United States Patent [19]

Dix et al.

[11] Patent Number: 4,880,769

[45] Date of Patent: Nov. 14, 1989

[54] TRANSFER OF CATINIC DYES IN THEIR DEPROTONATED, ELECTRICALLY NEUTRAL FORM

[75] Inventors: Johannes P. Dix, Neuhofen; Karl-Heinz Etzbach; Udo Mayer, both of Frankenthal; Ruediger Sens, Mannheim, all of Fed. Rep. of Germany

[73] Assignee: BASF Aktiengesellschaft, Ludwigshafen, Fed. Rep. of Germany

[21] Appl. No.: 134,979

[22] Filed: Dec. 18, 1987

[30] Foreign Application Priority Data

Dec. 24, 1986 [DE] Fed. Rep. of Germany ..... 3644369

[51] Int. Cl.[4] ..... B41M 5/035; B41M 5/26

[52] U.S. Cl. ..... 503/227; 8/471; 428/913; 428/914

[58] Field of Search ..... 8/470, 471; 427/146, 427/256; 428/195, 913, 914; 430/945; 503/227

[56] References Cited

U.S. PATENT DOCUMENTS

| | | | |
|---|---|---|---|
| 4,057,388 | 11/1977 | Defago et al. | 106/22 |
| 4,082,713 | 4/1978 | Kelley | 428/914 |
| 4,137,042 | 1/1979 | Defago et al. | 428/913 |

FOREIGN PATENT DOCUMENTS

| | | | |
|---|---|---|---|
| 0005451 | 11/1979 | European Pat. Off. . | |
| 0038736 | 10/1981 | European Pat. Off. . | |
| 0178832 | 4/1986 | European Pat. Off. | 503/227 |
| 2158121 | 6/1973 | Fed. Rep. of Germany . | |
| 2359515 | 6/1974 | Fed. Rep. of Germany | 503/227 |
| 2521988 | 12/1975 | Fed. Rep. of Germany | 503/227 |
| 2631832 | 1/1978 | Fed. Rep. of Germany . | |
| 3011154 | 10/1981 | Fed. Rep. of Germany . | |
| 3524519 | 1/1986 | Fed. Rep. of Germany . | |
| 0031564 | 2/1985 | Japan | 503/227 |
| 0053565 | 3/1985 | Japan | 503/227 |
| 1018797 | 2/1966 | United Kingdom | 8/471 |

OTHER PUBLICATIONS

Wochenblatt fuer Papierfabrikation, vol. 21, pp. 767–776, 1982, Rohmann et al, "Bindemittlesysteme fuer Chemische . . ."

Ullmanns Encyklopaedie der technischen Chemie, 4th Ed., vol. 13, pp. 571–573.

Rev. Prog. Coloration, vol. 5, 1974, pp. 65–74, Mayer et al., "Basic Dyes for Synthetic-Polymer Fibres".

Venkataraman, The Chemistry of Synthetic Dyes, vol. 4, p. 161.

*Primary Examiner*—Bruce H. Hess

*Attorney, Agent, or Firm*—Oblon, Spivak, McClelland, Maier & Neustadt

[57] ABSTRACT

Dyes are transferred from a substrate to an acceptor by sublimation or vaporization of the dye by means of a thermal printing head by using a substrate on which there is situated cationic dyes having a cyanine chromophore and one or more N-H groups which are part of the cyanine chromophore, in their electrically neutral form as the result of deprotonation at the N-H group and transferring these deprotonated dyes to a coated paper.

4 Claims, No Drawings

TRANSFER OF CATINIC DYES IN THEIR DEPROTONATED, ELECTRICALLY NEUTRAL FORM

The present invention relates to a novel process for transferring a cationic dye having a cyanine chromophore in its deprotonated, electrically neutral form from a substrate to a coated paper.

In the sublimation transfer process, a transfer sheet, containing a sublimable dye with or without a binder on a substrate, is heated from the back with a heater head emitting short heating pulses, and the dye sublimes or vaporizes and becomes transferred to a paper serving as a acceptor medium. The chief advantage of this process is that control of the amount of dye to be transferred (and hence the gradation of color) is easily possible by setting the amount of energy to be emitted by the heater head.

In general, the color recording is carried out using the three subtractive primaries yellow, magenta and cyan (with or without black). To make possible optimal color recording, the dyes used therein should have the following properties:

easy sublimability or vaporizability (which requirement is in general most difficult to meet with the cyan dyes);

high thermal and photochemical stability and resistance to moisture and chemicals;

suitable hues for subtractive color mixing;

a high molecular absorption coefficient;

easy industrial accessibility.

Most of the existing dyes used for thermal transfer printing, however, do not meet these requirements to a sufficient degree.

For instance, DE-A-2,359,515 discloses a process for dyeing and printing acrylic fabric by transferring salts of cationic dyes from a substrate to the acrylic material by heating. These salts should be derived from acids having $pk_a$ values greater than 3. However, it has been found that the thermotransfer of these salts leads only to inadequate colorings since high energies are required to convert these dye salts into the gas phase by vaporization or sublimation. In addition, the dyes are partially decomposed under these conditions.

EP-A-178,832 describes the thermotransfer to polyester of salts of cationic dyes with soft anionic bases.

Finally, DE-A-2,521,988 teaches the dyeing and printing of acrylic by thermotransfer of electrically neutral, deprotonated cationic dyes in the presence of an additional indicator dye. The presence of an indicator dye is necessary to avoid the formation of faulty prints. The thermotransfer takes place at 195° C. However, it is known that many cationic dyes are not thermostable in the form of their free dye base, so that in many cases the neutral dye base undergoes partial decomposition on heating.

It is an object of the present invention to provide a process for transferring a dye which should be easily sublimable or vaporizable under the application conditions of a thermal printing head, should not undergo thermal or photochemical decomposition, be processible into a printing ink and meet the coloristic requirements. In addition, the dye should be industrially easily accessible.

We have found that this object is achieved and the transfer of a dye from a substrate to an acceptor by sublimation or vaporization of the dye using a thermal printing head is advantageously possible by using a substrate on which there is situated a cationic dye having a cyanine chromophore and one or more N-H groups which are part of the cyanine chromophore, in its electrically neutral form as the result of deprotonation at the N-H group, and transferring this deprotonated dye to a coated paper.

For the purposes of the present invention, a cationic dye having a cyanine chromophore is a cationic dye having conjugated double bonds with a nitrogen atom at either or both ends of the conjugated system and in which the positive charge is delocalized in an alternating manner along the conjugated system (chromophore chain).

The delocalization of the positive charge is represented graphically in a conventional manner by means of a dotted line along the conjugated system, in which case only single bonds are shown in the formulae.

Preference is given to transferring in their deprotonated, electrically neutral form cationic dyes whose cations have the formula I

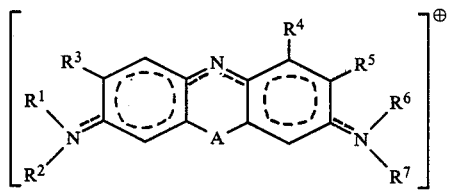

(I)

where $R^1$, $R^2$ and $R^7$ are identical or different and each, independently of the others, is hydrogen, $C_1$–$C_4$-alkyl, which may be substituted by $C_1$–$C_4$-alkoxy, $C_1$–$C_4$-alkylthio, halogen, cyano, hydroxyl or phenyl, or $C_5$–$C_7$-cycloalkyl, or $R^1$ and $R^2$ together with the nitrogen atom joining them form a 5- or 6-membered, saturated heterocyclic radical, $R^3$ and $R^5$ are identical or different and each, independently of the other, is hydrogen, $C_1$–$C_4$-alkyl, $C_1$–$C_4$-alkoxy or halogen, $R^4$ is hydrogen or together with $R^5$ is a fused-on benzo ring, $R^6$ is hydrogen, $C_1$–$C_4$-alkyl, which may be substituted by $C_1$–$C_4$-alkoxy, $C_1$–$C_4$-alkylthio, halogen, cyano, hydroxyl or phenyl, $C_5$–$C_7$-cycloalkyl or the radical

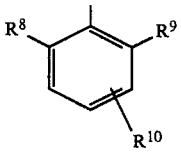

where $R^8$, $R^9$ and $R^{10}$ are identical or different and each, independently of the others, is hydrogen, $C_1$–$C_4$-alkyl, $C_1$–$C_4$-alkoxy or halogen, and A is oxygen or sulfur.

A further preferred process comprises transferring in its deprotonated, electrically neutral form a cationic dye whose cation has the formula II

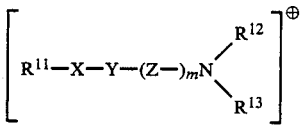

(II)

where $R^{11}$ is a heterocyclic radical

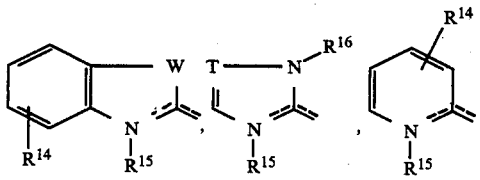

or

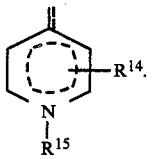

where $R^{14}$ is hydrogen, $C_1$–$C_4$-alkyl which may be substituted by halogen, hydroxyl or $C_1$–$C_4$-alkoxy, or $C_1$–$C_4$-alkoxy, $R^{15}$ and $R^{16}$ are identical or different and each, independently of the other, is hydrogen, $C_1$–$C_4$-alkyl, which may be substituted by halogen, hydroxyl, $C_1$–$C_4$-alkoxy or phenyl, or unsubstituted or $C_1$–$C_4$-alkyl, $C_1$–$C_4$-alkoxy- or halogen-substituted phenyl, W is sulfur or di-$C_1$–$C_4$-alkylmethylene and T is CH or nitrogen, $R^{12}$ is hydrogen, $C_1$–$C_4$-alkyl, which may be substituted by halogen or $C_1$–$C_4$-alkoxy, or unsubstituted or $C_1$–$C_4$-alkyl-, $C_1$–$C_4$-alkoxy- or halogen-substituted phenyl, $R^{13}$ is hydrogen or $C_1$–$C_4$-alkyl, which may be substituted by halogen or $C_1$–$C_4$-alkoxy, X and Y are identical or different and each, independently of the other, is CH or nitrogen, Z is the radical

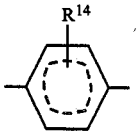

and m is 0 or 1 or where, if m is 1, the group

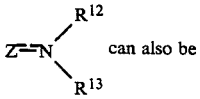

can also be

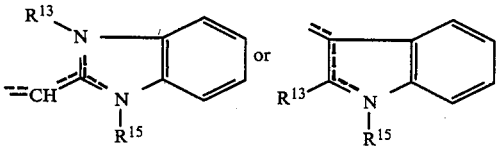

where $R^{13}$ and $R^{15}$ each have the abovementioned meanings, with the proviso that if m is O, X and Y should not simultaneously be nitrogen.

The alkyl radicals appearing in the formulae I and II can be not only straight-chain but also branched. Halogen is in each case particularly preferably fluorine, chlorine or bromine.

$R^1$, $R^2$, $R^6$ and $R^7$ in the formula I are in each case for example hydrogen, methyl, ethyl, propyl, isopropyl, butyl, isobutyl, sec-butyl, tert-butyl, 2-methoxyethyl, 2-ethoxyethyl, 2-propoxyethyl, 2-isopropoxyethyl, 2-butoxyethyl, 2-sec-butoxyethyl, 2-methoxypropyl, 1-methoxyprop-2-yl, 2-methoxybutyl, 2-ethoxybutyl, 4-isopropoxybutyl, 2-methylthioethyl, 2-ethylthioethyl, 2-propylthioethyl, 2-isopropylthioethyl, 2-butylthioethyl, 2-isobutylthioethyl, 2-methylthiopropyl, 2-ethylthioprop-1-yl, 2-methylthiobutyl, 2-ethylthiobutyl, 4-ethylthiobutyl, 4-propylthiobutyl, fluoromethyl, chloromethyl, difluoromethyl, trifluoromethyl, 2-fluoroethyl, 2-chloroethyl, 2-bromoethyl, pentafluoroethyl, 2-chloro-1,1,2,2-tetrafluoroethyl, nonafluorobutyl, cyanomethyl, 2-cyanoethyl, 2-cyanopropyl, 3-cyanopropyl, 2-cyanobutyl, 4-cyanobutyl 2-hydroxyethyl, 2-hydroxypropyl, 1-hydroxyprop-2-yl, 3-hydroxypropyl, 2-hydroxybutyl, 4-hydroxybutyl, benzyl, 2-phenylethyl, cyclopentyl, cyclohexyl or cycloheptyl.

$R^1$ and $R^2$ in the formula I, together with the nitrogen atom joining them, are also for example one of the following heterocyclic radicals: pyrrolidino, piperidino, morpholino, N-methylpiperazino, N-ethylpiperazino, N-propylpiperazino, N-isopropylpiperazino, N-butylpiperazino, N-isobutylpiperazino or N-sec-butylpiperazino.

$R^6$ in the formula I is also for example phenyl, 2-methylphenyl, 2-ethylphenyl, 2-propylphenyl, 2-isopropylphenyl, 2-butylphenyl, 2,6-dimethylphenyl, 2,6-diethylphenyl, 2,4,6-trimethylphenyl, 2-methoxyphenyl, 2-ethoxyphenyl, 2-propoxyphenyl, 2-isopropoxyphenyl, 2-butoxyphenyl, 2,4-dimethoxyphenyl, 2,6-dimethoxyphenyl, 2-methoxy-4-methoxyphenyl, 2-fluorophenyl, 2-chlorophenyl, 2-bromophenyl, 2,4-dichlorophenyl or 2,4,6-trichlorophenyl.

$R^3$ and $R^5$ in the formula I are each for example hydrogen, methyl, ethyl, propyl, isopropyl, butyl, isobutyl, sec-butyl, tert-butyl, methoxy, ethoxy, propoxy, isopropoxy, butoxy, isobutoxy, sec-butoxy, fluorine, chlorine, bromine or iodine.

$R^{12}$, $R^{13}$, $R^{14}$, $R^{15}$ and $R^{16}$ in the formula II are each for example hydrogen, methyl, ethyl, propyl, isopropyl, butyl, isobutyl, sec-butyl, tert-butyl, 2-methoxyethyl, 2-ethoxyethyl, 2-propoxyethyl, 2-isopropoxyethyl, 2-butoxyethyl, 2-sec-butoxyethyl, 2-methoxypropyl, 1-methoxyprop-2-yl, 2-methoxybutyl, 2-ethoxybutyl, 4-isopropoxybutyl, chloromethyl, difluoromethyl, trifluoromethyl, 2-fluoroethyl, 2-chloroethyl, 2-bromoethyl, pentafluoroethyl, 2-chloro-1,1,2,2-tetrafluoroethyl or nonafluorobutyl.

$R^{12}$ and also $R^{15}$ and $R^{16}$ in the formula II are each also for example phenyl, 2-methylphenyl, 4-methylphenyl, 2-ethylphenyl, 4-ethylphenyl, 4-isopropylphenyl, 4-butylphenyl, 2,4-dimethylphenyl, 2,4,6-trimethylphenyl, 2-methoxyphenyl, 4-methoxyphenyl, 4-ethoxyphenyl, 2,4-dimethoxyphenyl, 2-chlorophenyl, 4-fluorophenyl, 4-bromophenyl or 2,6-dichlorophenyl.

$R^{14}$ in the formula II can further be for example methoxy, ethoxy, propoxy, isopropoxy, butoxy, isobutoxy or sec-butoxy, $R^{14}$, $R^{15}$ and $R^{16}$ are each further for example 2-hydroxyethyl, 2-hydroxypropyl, 3-hydroxypropyl, 2-hydroxybutyl or 4-hydroxybutyl.

$R^{14}$ and $R^{15}$ can each also be for example benzyl or 2-phenylethyl.

W in the formula II is for example sulfur, prop-2-ylidene, but-2-ylidene, pent-3-ylidene, hex-2-ylidene, hept-4-ylidene or non-5-ylidene.

A particularly preferred process comprises transferring in its deprotonated, electrically neutral form a cationic dye whose cation has the formula I where $R^1$, $R^2$ and $R^7$ are identical or different and each, independently of the others is hydrogen or $C_1$–$C_4$-alkyl, which may be substituted by $C_1$–$C_4$-alkoxy, halogen, cyano or hydroxyl, or $R^1$ and $R^2$ together with the nitrogen atom joining them are pyrrolidino, piperidino or morpholino, $R^3$ and $R^5$ are identical or different and each, independently of the other, is hydrogen, $C_1$–$C_4$-alkyl or $C_1$–$C_4$-alkoxy, $R^4$ is hydrogen, $R^6$ is the radical

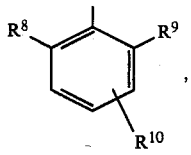

where $R^8$ and $R^9$ are identical or different and each, independently of the other, is hydrogen, $C_1$–$C_4$-alkyl or $C_1$–$C_4$-alkoxy, $R^{10}$ is hydrogen and A is oxygen.

A further particularly preferred process comprises transferring in its deprotonated, electrically neutral form a cationic dye whose cation has the formula I where $R^1$, $R^2$ and $R^7$ are identical or different and each, independently of the others, is hydrogen or $C_1$–$C_4$-alkyl, which may be substituted by $C_1$–$C_4$-alkoxy, halogen, cyano, or hydroxyl, or $R^1$ and $R^2$ together with the nitrogen atom joining them are pyrrolidino, piperidino or morpholino, $R^3$ and $R^5$ are identical or different and each, independently of the other is hydrogen, $C_1$–$C_4$-alkyl or $C_1$–$C_4$-alkoxy, $R^4$ is hydrogen, $R^6$ is $C_1$–$C_4$-alkyl, which may be substituted by $C_1$–$C_4$-alkoxy, halogen, cyano or hydroxyl, and A is oxygen.

A very particularly noteworthy process comprises transferring a cationic dye whose cation has the formula I where $R^1$, $R^2$ and $R^7$ are identical or different and each, independently of the others, is hydrogen or $C_1$–$C_4$-alkyl, $R^3$ and $R^5$ are each hydrogen or $C_1$–$C_4$-alkyl, $R^4$ is hydrogen, $R^6$ is hydrogen, $C_1$–$C_4$-alkyl or a radical

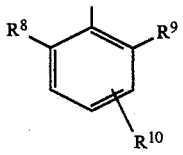

where $R^8$ and $R^9$ are identical or different and each, independently of the other, is hydrogen, $C_1$–$C_4$-alkyl or $C_1$–$C_4$-alkoxy, $R^{10}$ is hydrogen, and A is oxygen.

A further particularly preferred process comprises transferring in its deprotonated, electrically neutral form a cationic dye whose cation has the formula II where $R^{11}$ is the heterocyclic radical

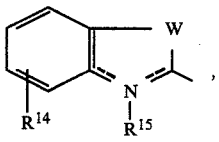

where $R^{14}$ is hydrogen, $R^{15}$ is $C_1$–$C_4$-alkyl, W is di-$C_1$–$C_4$-alkylmethylene, $R^{12}$ is $C_1$–$C_4$-alkyl- or $C_1$–$C_4$-alkoxy-substituted phenyl, $R^{13}$ is hydrogen, X and Y are each CH, and m is 0.

Further cationic dyes suitable for transfer in their deprotonated, electrically neutral form by the process according to the invention comprise those whose cations have the formulae III and IV

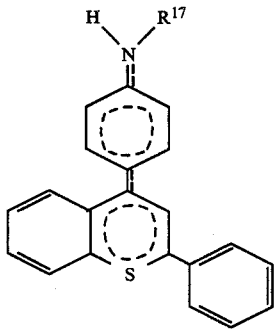

(III)

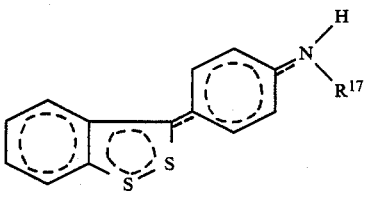

(IV)

where $R^{17}$ is in each case $C_1$–$C_4$-alkyl.

Hereinbefore the cationic dyes mentioned were in each case specified only in terms of their cations (formulae I to IV). However, it will be readily understood that the cationic dyes in question are present in salt form and each additionally have an anion. The anion can be any customary anion, specifically fluoride, chloride, bromide, iodide, sulfate, methosulfate, ethosulfate, carbonate, perchlorate, borate, tetrafluoroborate, tetrachlorozincate, phosphate, methylsulfonate, phenylsulfonate, 4-methylphenylsulfonate or carboxylates such as formate, acetate, propionate, butyrate, 2-ethylhexanoate, benzoate or 4-methylbenzoate. The use of tetrachlorozincate salts for producing the deprotonated, electrically neutral dye form is preferred.

The dyes whose cations conform to the formula I to IV are known per se or can be obtained by methods known per se.

For instance, those dyes whose cation conforms to the formula I where A is oxygen are obtainable by the methods of preparation indicated in DE-A-2,158,121, DE-A-3,011,154, EP-A-5,451, EP-A-38,736 or GB-A-1,018,797. The corresponding thiazine derivatives (A=sulfur) can be prepared by oxidatively coupling suitable 1,4-diaminobenzene derivatives with aniline derivatives and subsequent reaction with hydrogen sulfide or with thiosulfate.

The other cationic dyes which in the process according to the invention are transferred in their deprotonated, electrically neutral form can likewise be prepared in a conventional manner as described for example in K. Venkataraman "The Chemistry of Synthetic Dyes", vol. IV, p. 161; Ullmann's Encyklopädie der Technischen Chemie, 4th edition, vol. 13, p. 571, or Rev. Prog. Coloration 5 (1974), 65.

To prepare the dye substrates required for the process according to the invention, it is advantageous first to prepare solutions of the cationic dyes, advantageously in the form of the tetrachlorozincate salt. Suitable solvents are inert organic solvents, eg. isobutanol, toluene, xylene or chlorobenzene. To these solutions is then added excess alkali metal alkanolate, eg. sodium methanolate or sodium ethanolate, to convert the cationic dye into its deprotonated, electrically neutral form. It has proven advantageous to use the alkali metal alkanolate in a molar excess from 1.1 to 1.3 times, based on the cationic dye.

The resulting solution containing the deprotonated, electrically neutral dye is processed with a binder into a printing ink. In the printing inkk, the deprotonated dye is present in a dissolved or dispersed form. The printing ink is knife-coated onto an inert substrate and dried in the air.

Suitable binders are for example ethylcellulose, polysulfones and polyether sulfones. Inert substrates are for example silk paper, blotting paper or imitation parchment and also plastics films of good thermal stability, for example possibly metal-coated polyester, polyamide or polyimide. The thickness of the substrate preferably ranges from 3 to 30 μm. Further substrates, binders and solvents for producing printing ink which are suitable for the process according to the invention are described in DE-A-3,524,519.

Acceptors in the process according to the invention are coated papers, in particular those having an acid-modified coating. Suitable coating materials are appropriate organic or inorganic materials of sufficient thermostability.

Suitable organic coating materials are for example acid-modified polyacrylonitrile, condensation products based on phenol/formaldehyde (see for example U.S.-A-4,082,713), certain salicylic acid derivatives (see for example DE-A-2,631,832) and acid-modified polyesters, the latter being preferred.

Suitable inorganic coating materials are for example acid-activated clays as used in chemical manifolding papers (see for example Wochenblatt für Papierfabrikation 21 (1982), 767).

The transfer of the deprotonated dye from the substrate to the acceptor is effected by means of a thermal printing head which must supply sufficient heat to the substrate to cause the deprotonated dye to vaporize or sublime within a few milliseconds and transfer to the plastics-coated, acid-modified paper. The transfer takes place at from 100° to 400° C., preferably at from 150° to 350° C.

In some cases, in particular if the paper used has a non-acid-modified coating, it can be of advantage, after the transfer, to subject the paper acceptor additionally to an acid aftertreatment, for example with gaseous hydrogen chloride or with dilute acetic acid.

Given the known thermolability of electrically neutral dye bases it is surprising that, in the process according to the invention, the cationic dyes in their deprotonated, electrically neutral form do not undergo any thermal decomposition or transformation reactions under the transfer conditions mentioned, but can be transferred to the acceptor in a rapid and problem-free manner.

The invention is illustrated in more detail by the following Examples:

To be able to test the transfer behavior of a dye quantitatively and simply, the thermotransfer was carried out using a large-area hot press instead of a thermal printing head. In addition, the dye substrate test specimens were prepared without a binder.

(A) General formulation for coating the substrate with deprotonated dye

First, a saturated solution of the cationic dye in the form of a tetrachlorozincate is prepared in a 1:1 v/v mixture of isobutanol and chlorobenzene. To this solution is added a 1.2-molar excess, based on the cationic dye, of sodium methanolate to form the deprotonated electrically neutral form of the dye. The formation of the dye base is readily apparent from the resulting color change of the reaction mixture. Thereafter the mixture is filtered, and the filtrate is coated with a 20 μm doctor blade from one to five times onto substrate paper and dried in the air. The substrate paper may also be sprayed with the filtrate.

(B) Testing of sublimation or vaporization behavior

The (donor) paper coated with the dye under test is placed with the side where the dye layer is onto a coated paper (acceptor) and pressed down. Donor/acceptor are then wrapped with aluminum foil and heated for 30 seconds between two hot plates. (The relatively long period of 30 seconds is chosen for convenience of measurement. This is because it is thereby ensured that, after the transfer has taken place, the acceptor can be photometrically measured in an ideal manner.) If a polyester-coated paper is used as the acceptor, the paper is briefly treated with gaseous hydrogen chloride after the transfer.

The amount of dye which has migrated into the paper is determined photometrically. In addition, the transmission values T obtained from the reflectance measurements are converted in accordance with the relationship: $A = -\log T$, into absorbence values. A plot of the logarithm of the absorbence A measured at various temperatures within the range from 100° to 200° C. on the dyed paper against the inverse of the corresponding absolute temperature is a straight line from whose slope the activation energy $\Delta E_T$ for the transfer experiment is calculated:

$$\Delta E_T = 2.3 \cdot R \cdot \frac{\Delta \log A}{\Delta\left(\frac{1}{T}\right)}$$

To complete the characterization, the plot additionally reveals the temperature T* (°C.) where the absorbence A of the dyed paper attains the value 1.

The Tables below indicate in each case only the cation forms of the dyes. As mentioned above, the anion was in all cases tetrachlorozincate. Me and Et in the formulae are methyl and ethyl respectively.

Tables 1 and 2 below indicate cationic dyes which were converted by method (A) into their deprotonated, electrically neutral form and applied to a substrate which was tested by method (B) in respect of the sublimation or vaporization behavior. The acceptor used was polyester-coated paper. The Tables give in each case the resulting hue and the thermotransfer parameters T* and $\Delta E_T$.
TABLE 1
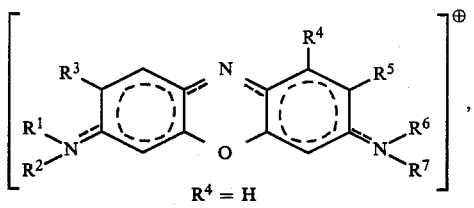
(I)
$R^4 = H$
| Example No. | $R^1$ | $R^2$ | $R^3$ | $R^5$ | $R^6$ | $R^7$ | Hue | T*[°C. | $\Delta E_T \left[\frac{Kcal}{Mol}\right]$ |
|---|---|---|---|---|---|---|---|---|---|
| 1 | Et | Et | H | H | 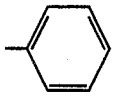 | H | cyan | 154 | 19 |
| 2 | Et | Et | H | H | 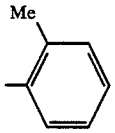 | H | cyan | 148 | 20 |
| 3 | Et | Et | H | H | 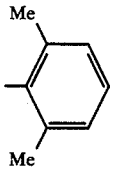 | H | cyan | 154 | 22 |
| 4 | Et | Et | H | H | 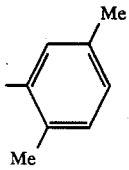 | H | cyan | 163 | 19 |
| 5 | Et | Et | H | H | 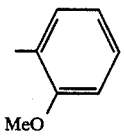 | H | cyan | 167 | 21 |
| 6 | Et | Et | H | H | 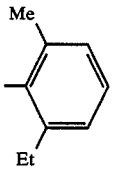 | H | cyan | 181 | 17 |
| 7 | Me | Me | H | H | 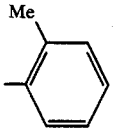 | H | cyan | 157 | 19 |
| 8 | H | Et | Me | H | 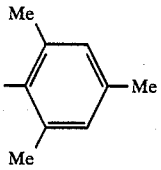 | H | blue | 161 | 26 |

TABLE 1-continued

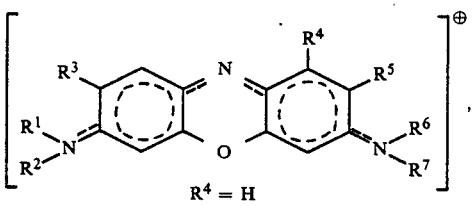

(I)

$R^4 = H$

| Example No. | $R^1$ | $R^2$ | $R^3$ | $R^5$ | $R^6$ | $R^7$ | Hue | T*[°C. | $\Delta E_T \left[\frac{Kcal}{Mol}\right]$ |
|---|---|---|---|---|---|---|---|---|---|
| 9 | H | ET | Me | H | 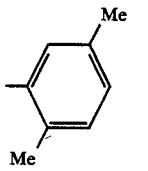 | H | blue | 168 | 18 |
| 10 | H | Et | Me | H | 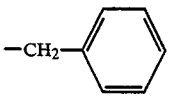 | Me | blue | 165 | 11 |
| 11 | H | Et | Me | H | 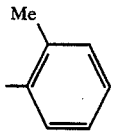 | H | blue | 154 | 21 |
| 12 | H | Et | Me | H | Me | Me | bluish cyan | 129 | 7 |
| 13 | H | H | Me | H | 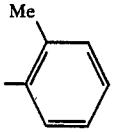 | Me | blue | 168 | 20 |
| 14 | H | H | Me | H | 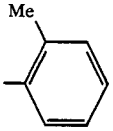 | H | reddish blue | 153 | 28 |
| 15 | H | H | Me | H | 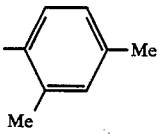 | H | reddish blue | 157 | 28 |
| 16 | H | H | Me | H | Et | Et | bluish cyan | 128 | 17 |
| 17 | Et | Et | H | OMe | H | H | blue | 152 | 37 |

TABLE 2

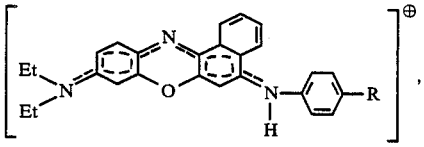

(I)

| Example No. | R | Hue | T*[°C.] | $\Delta E_T \left[\frac{kcal}{Mol}\right]$ |
|---|---|---|---|---|
| 18 | H | greenish blue | 178 | 21 |

TABLE 2-continued

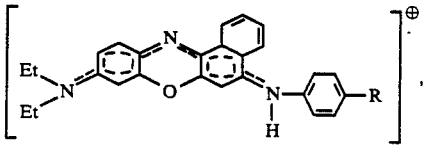

(I)

| Example No. | R | Hue | T*[°C.] | $\Delta E_T \left[\frac{kcal}{Mol}\right]$ |
|---|---|---|---|---|
| 19 | Me | greenish blue | 189 | 22 |

Tables 3 and 4 below mention cationic dyes which were converted by method (A) into their deprotonated, electrically neutral form, and applied to a substrate which was tested by method (B) in respect of the sublimation or vaporization behavior. The acceptor used was paper coated with acid-activated clay. Here the transfer took place at 130° C. in the course of 30 seconds.

The "Abs" listed in Tables 3 and 4 signifies absorption. The absorption is linked to the transmission T by the following equation: Abs=1−T.

TABLE 3

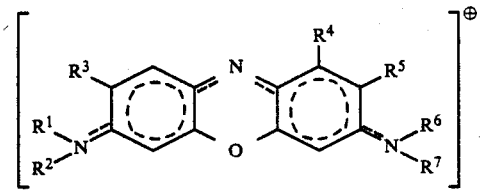

| Example No. | $R^1$ | $R^2$ | $R^3$ | $R^5$ | $R^6$ | $R^7$ | Hue | Abs. |
|---|---|---|---|---|---|---|---|---|
| 20 | Et | Et | H | H | 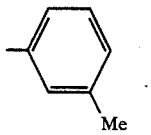 | H | cyan | 0.43 |
| 21 | Et | Et | H | H | 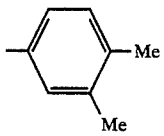 | H | cyan | 0.30 |
| 22 | Et | Et | H | H | 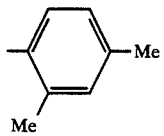 | H | cyan | 0.42 |
| 23 | Et | Et | H | H | 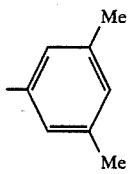 | H | cyan | 0.37 |
| 24 | Et | Et | H | H | 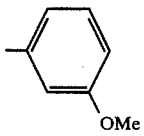 | H | cyan | 0.25 |
| 25 | Et | Et | H | H | 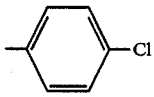 | H | cyan | 0.51 |
| 26 | Et | Et | H | H | 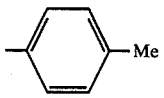 | H | cyan | 0.40 |
| 27 | Et | Et | H | H | 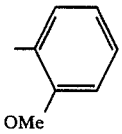 | H | cyan | 0.24 |

TABLE 3-continued
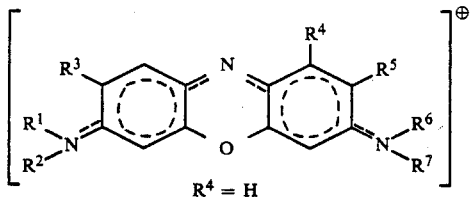
$R^4 = H$
| Example No. | $R^1$ | $R^2$ | $R^3$ | $R^5$ | $R^6$ | $R^7$ | Hue | Abs. |
|---|---|---|---|---|---|---|---|---|
| 28 | Et | Et | H | H | 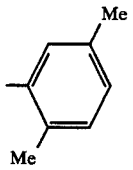 | H | cyan | 0.43 |
| 29 | Et | Et | H | H | 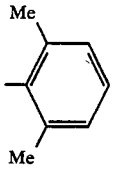 | H | bluish cyan | 0.57 |
| 30 | Et | Et | H | H | 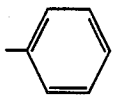 | H | cyan | 0.56 |
| 31 | Et | Et | H | H | 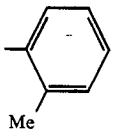 | H | cyan | 0.63 |
| 32 | Et | Et | H | H | 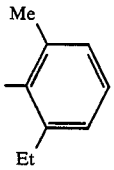 | H | cyan | 0.39 |
| 33 | Me | Me | H | H | 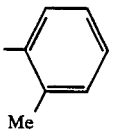 | H | cyan | 0.64 |
| 34 | Me | Me | H | H | 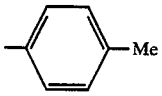 | H | cyan | 0.43 |
| 35 | Me | Me | H | H | 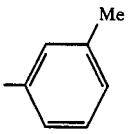 | H | cyan | 0.41 |

TABLE 3-continued
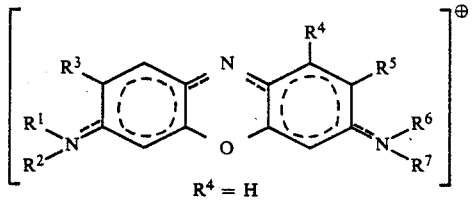
$R^4 = H$
| Example No. | $R^1$ | $R^2$ | $R^3$ | $R^5$ | $R^6$ | $R^7$ | Hue | Abs. |
|---|---|---|---|---|---|---|---|---|
| 36 | H | Et | Me | H | 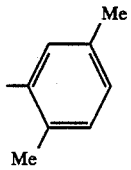 | H | blue | 0.42 |
| 37 | H | Et | Me | H | 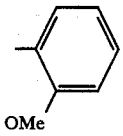 | H | reddish blue | 0.26 |
| 38 | H | Et | Me | H | Me | Me | reddish blue | 0.90 |
| 39 | H | Et | Me | H | 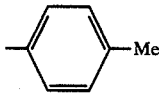 | Me | reddish blue | 0.49 |
| 40 | H | Et | Me | H | 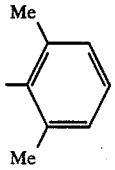 | H | reddish blue | 0.55 |
| 41 | H | Et | Me | H | 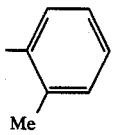 | H | reddish blue | 0.50 |
| 42 | H | Et | Me | H | 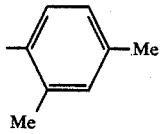 | H | blue | 0.36 |
| 43 | H | Et | Me | H | 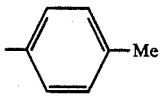 | H | blue | 0.31 |
| 44 | H | Et | Me | H | 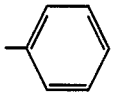 | Me | blue | 0.72 |
| 45 | H | Et | Me | H | 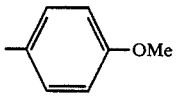 | H | blue | 0.11 |

TABLE 3-continued
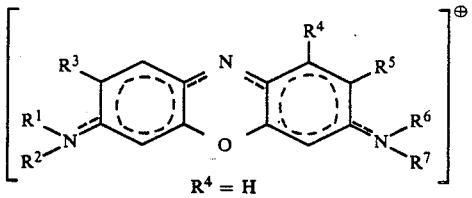
$R^4 = H$
| Example No. | $R^1$ | $R^2$ | $R^3$ | $R^5$ | $R^6$ | $R^7$ | Hue | Abs. |
|---|---|---|---|---|---|---|---|---|
| 46 | H | Et | Me | H | 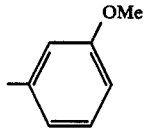 | H | blue | 0.19 |
| 47 | H | Et | Me | H | 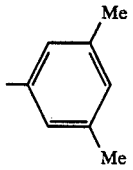 | H | bluish cyan | 0.20 |
| 48 | H | Et | Me | H | 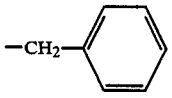 | 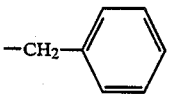 | reddish blue | 0.27 |
| 49 | H | Et | Me | H | 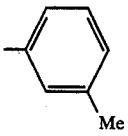 | Me | blue | 0.49 |
| 50 | H | Et | Me | H | 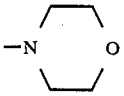 | | blue | 0.64 |
| 51 | H | H | Me | H | 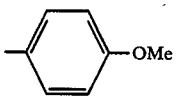 | H | reddish blue | 0.22 |
| 52 | H | H | Me | H | 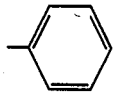 | Me | reddish blue | 0.66 |
| 53 | H | H | Me | H | Et | Et | cyan | >0.95 |
| 54 | H | H | Me | H | 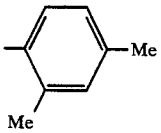 | H | reddish blue | 0.31 |
| 55 | H | H | Me | H | 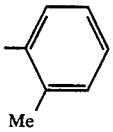 | H | reddish blue | 0.54 |

TABLE 3-continued

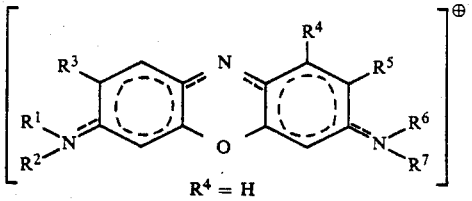

$R^4 = H$

| Example No. | $R^1$ | $R^2$ | $R^3$ | $R^5$ | $R^6$ | $R^7$ | Hue | Abs. |
|---|---|---|---|---|---|---|---|---|
| 56 | H | H | Me | H | 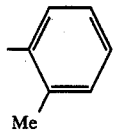 | Me | reddish blue | 0.56 |
| 57 | H | H | Me | H | Me | Me | cyan | >0.95 |
| 58 | H | H | Me | H | 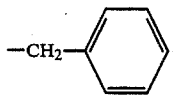 | Me | cyan | 0.83 |
| 59 | H | H | Me | H | 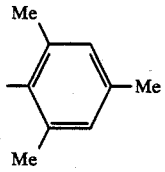 | H | reddish blue | 0.43 |
| 60 | H | Et | H | H | 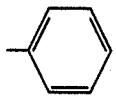 | H | blue | 0.46 |
| 61 | H | H | OMe | H | Et | Et | bluish cyan | 0.66 |
| 62 | Me | Me | H | OMe | H | H | cyan | 0.62 |
| 63 | H | Me | Me | Me | H | Et | reddish blue | 0.87 |

TABLE 4

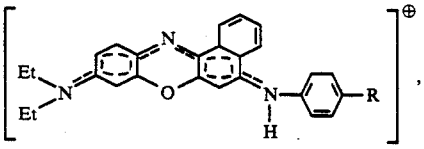

(I)

| Example No. | R | Hue | Abs. |
|---|---|---|---|
| 64 | Me | cyan/ greenish blue | 0.03 |
| 65 | H | cyan/ | 0.22 |

TABLE 4-continued

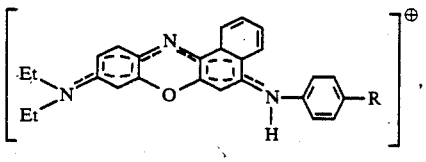

(I)

| Example No. | R | Hue | Abs. |
|---|---|---|---|
| | | greenish blue | |

The cationic dyes listed in Table 5 below were transferred to their deprotonated, electrically neutral form under the conditions holding for Table 1.

TABLE 5

| Example No. | Dye cation | Hue | T*[°C.] | $\Delta E_T \left[\frac{kcal}{Mol}\right]$ |
|---|---|---|---|---|
| 66 | 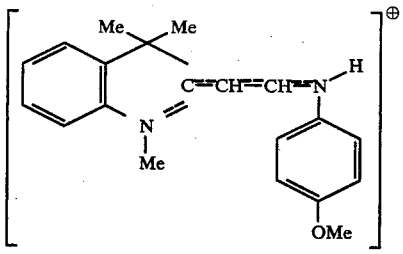 | yellow | 131 | 19 |
| 67 | 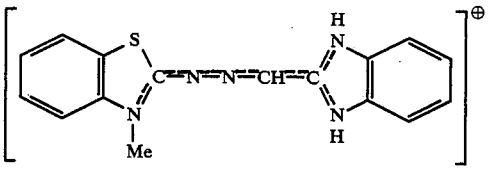 | yellow | 161 | 24 |
| 68 | 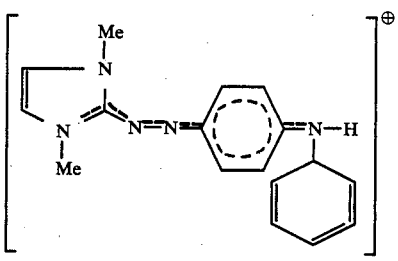 | dull bluish red | 160 | 23 |
| 69 | 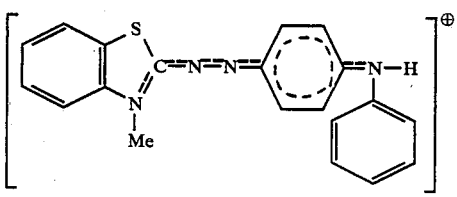 | blue | 171 | 25 |
| 70 | 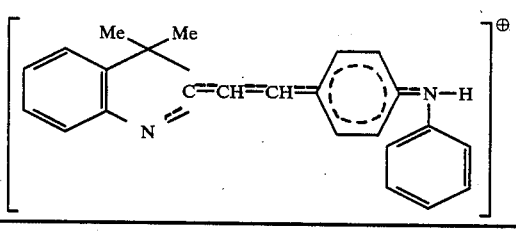 | reddish violet | 152 | 24 |

Similar results were obtained with the cationic dyes mentioned in Tables 6 and 7 on transfer in their deprotonated, electrically neutral form to paper coated with acid-activated clay. The resulting hue is indicated in each case.

TABLE 6

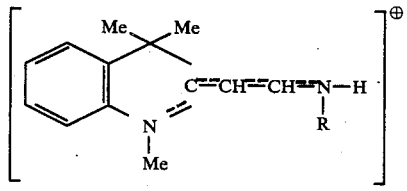

| Example No. | R | Hue |
|---|---|---|
| 71 | 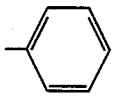 | pale yellow |

TABLE 6-continued
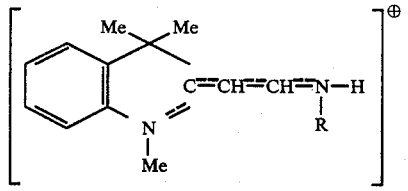
| Example No. | R | Hue |
|---|---|---|
| 72 | 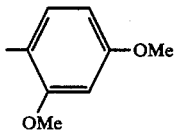 | yellow |
| 73 | 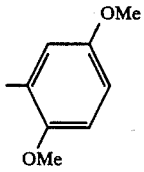 | yellow |
TABLE 6-continued
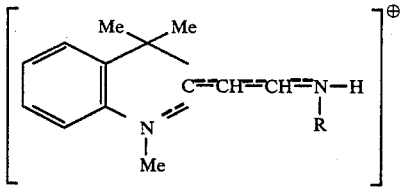
| Example No. | R | Hue |
|---|---|---|
| 74 | 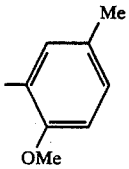 | yellow |
| 75 | 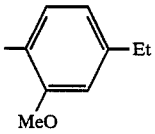 | yellow |
| 76 | 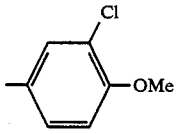 | yellow |
TABLE 7
| Example No. | Dye cation | Hue |
|---|---|---|
| 77 | 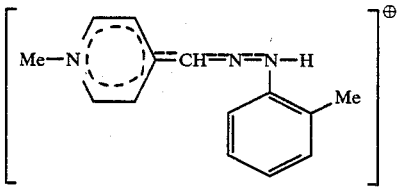 | yellow |
| 78 | 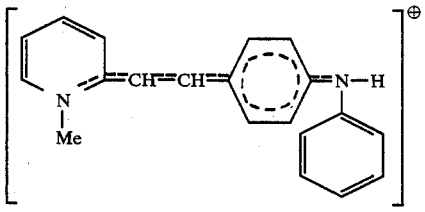 | yellow |
| 79 | 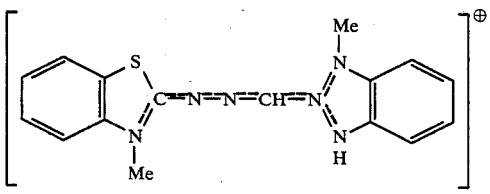 | yellow |

TABLE 7-continued
| Example No. | Dye cation | Hue |
|---|---|---|
| 80 | 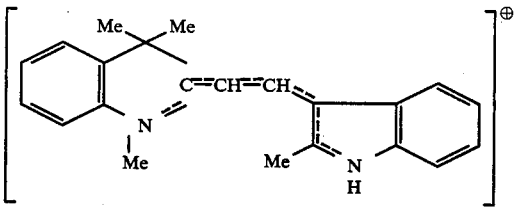 | reddish orange |
| 81 | 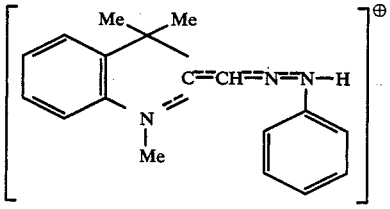 | yellowish orange |
| 82 | 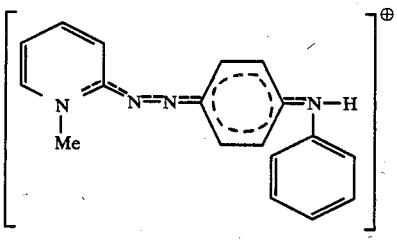 | red |
| 83 | 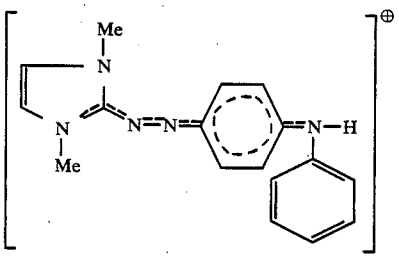 | dull bluish red |
| 84 | 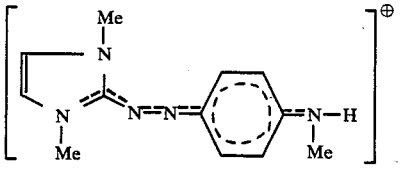 | dull bluish red |
| 85 | 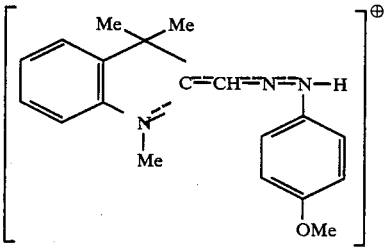 | reddish orange |

TABLE 7-continued
| Example No. | Dye cation | Hue |
|---|---|---|
| 86 | 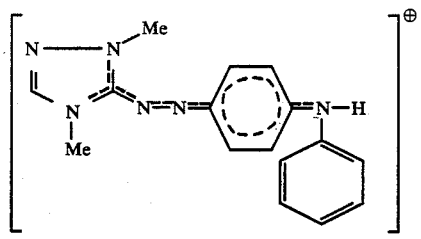 | reddish |
| 87 | 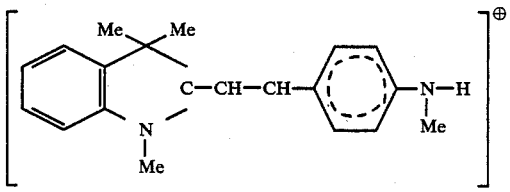 | red |
| 88 | 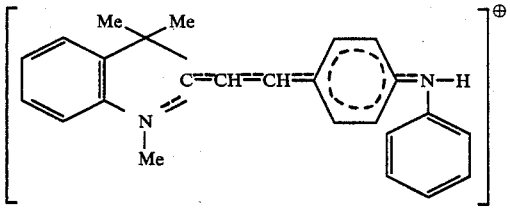 | red |
| 89 | 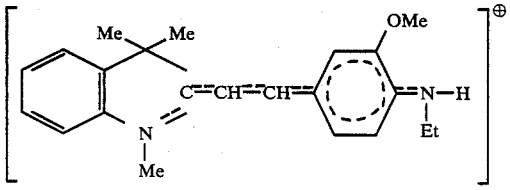 | red |
| 90 | 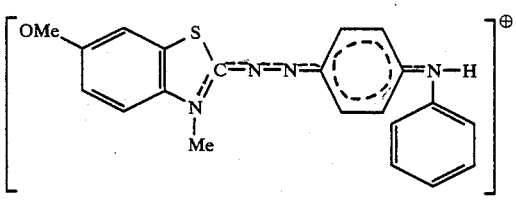 | blue |
| 91 | 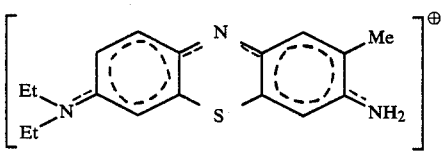 | cyan |
| 92 | 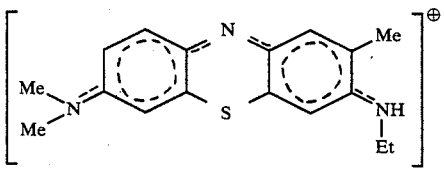 | cyan |

TABLE 7-continued

| Example No. | Dye cation | Hue |
|---|---|---|
| 93 | 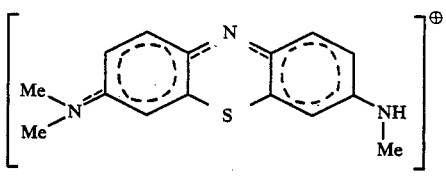 | cyan |
| 94 | 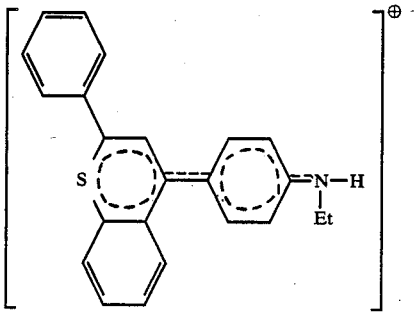 | blue |
| 95 | 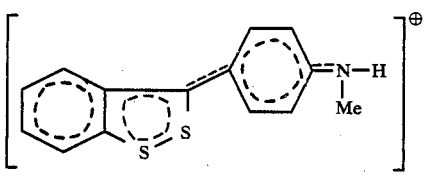 | blue |
| 96 | 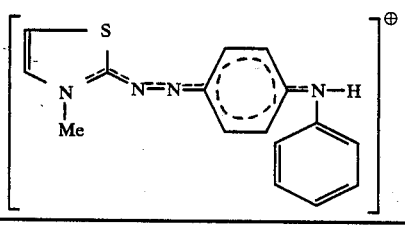 | reddish blue |

We claim:

1. A process for transferring a dye from a substrate to an acceptor by sublimation or vaporization of the dye using a thermal printing head which comprises using a substrate on which there is situated a cationic dye and a binder, said cationic dye having a cyanine chromaphore and one or more N-H groups which are part of the cyanine chromaphore, in its electrically neutral form as the result of deprotonation at the N-H group, and transferring said deprotonated dye to a coated paper, said cationic dye having a cation of the formula

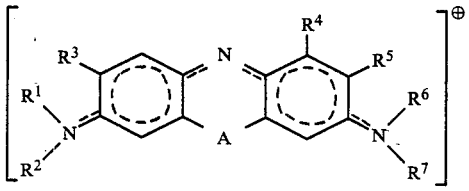

where $R^1$ and $R^2$ are hydrogen, methyl or ethyl,
$R^3$ and $R^5$ are hydrogen, methyl or methoxy,
$R^4$ is hydrogen,
$R^6$ is hydrogen, methyl, ethyl

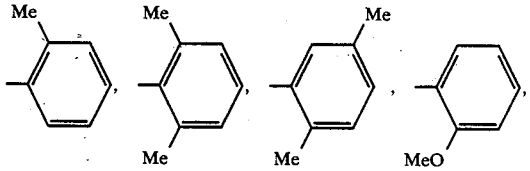

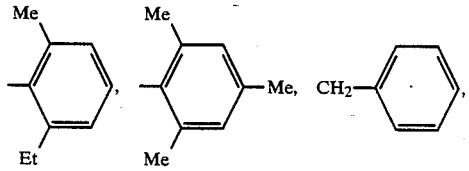

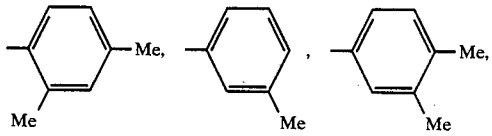

-continued
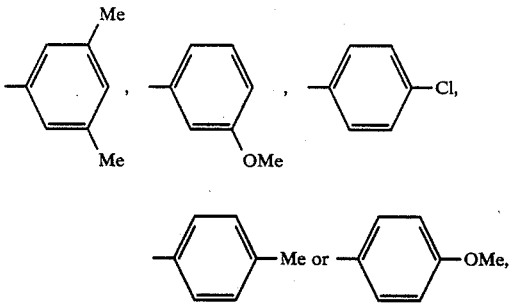
$R^7$ is hydrogen, methyl, ethyl or
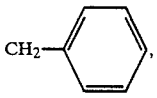
and
A is oxygen.
2. The process of claim 1, wherein the binder is ethylcellulose.
3. The process of claim 1, wherein the binder is a polysulfone.
4. The process of claim 1, wherein the binder is a polyether sulfone.
* * * * *

UNITED STATES PATENT AND TRADEMARK OFFICE

CERTIFICATE OF CORRECTION

PATENT NO. : 4,880,769

DATED : Nov. 14, 1989

INVENTOR(S) : Johannes P. Dix, et al

It is certified that error appears in the above-identified patent and that said Letters Patent is hereby corrected as shown below:

The Title information is incorrectly recorded, "Catinic" should be: --Cationic--

Signed and Sealed this

Fifteenth Day of January, 1991

*Attest:*

HARRY F. MANBECK, JR.

*Attesting Officer*

*Commissioner of Patents and Trademarks*